US007016641B2

(12) United States Patent
Matsumoto et al.

(10) Patent No.: US 7,016,641 B2
(45) Date of Patent: Mar. 21, 2006

(54) SHEET-FEEDING DEVICE HAVING HEATER FOR HEATING SHEET

(75) Inventors: Yuzoh Matsumoto, Toride (JP); Shunichi Komatsu, Abiko (JP); Kunio Tsuruno, Tokyo (JP); Yasuo Fukatsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 10/927,767

(22) Filed: Aug. 26, 2004

(65) Prior Publication Data

US 2005/0053401 A1 Mar. 10, 2005

(30) Foreign Application Priority Data

Sep. 1, 2003 (JP) ..... 2003-308784

(51) Int. Cl.
*G03G 15/00* (2006.01)

(52) U.S. Cl. ..... 399/390; 101/232; 271/97

(58) Field of Classification Search ..... 399/390, 399/391, 393; 271/3.01, 3.08, 3.13, 3.15, 271/18, 97, 105; 101/232
See application file for complete search history.

(56) References Cited

U.S. PATENT DOCUMENTS 5,476,041 A * 12/1995 Czotscher ..... 101/232
5,645,274 A * 7/1997 Ubayashi et al. ..... 271/94
6,015,144 A 1/2000 Yoshii et al.
6,942,208 B1 * 9/2005 Okazaki et al. ..... 271/97

FOREIGN PATENT DOCUMENTS

JP 06-032473 A 2/1994
JP 2001-048366 A 2/2001

* cited by examiner

*Primary Examiner*—Ren Yan
(74) *Attorney, Agent, or Firm*—Canon U.S.A. Inc. I P Div

(57) ABSTRACT

A sheet-feeding device for separating sheets stored in a sheet storage unit by blowing air heated by a heater toward the sheets includes a controller which detects an abnormality when a heater temperature does not reach a first predetermined temperature within a predetermined time. The controller continues to control the heater temperature but stops determining whether or not the heater temperature is increased to the first predetermined temperature within the predetermined time when it is detected that the sheet storage unit is in an open state.

7 Claims, 5 Drawing Sheets

SHEET-FEEDING DEVICE HAVING HEATER FOR HEATING SHEET

CROSS REFERENCE TO RELATED APPLICATIONS

This application claims priority from Japanese Patent Application No. 2003-308784 filed Sep. 1, 2003, which is hereby incorporated by reference herein.

BACKGROUND OF THE INVENTION

1. Field of the Invention

The present invention relates to a sheet-feeding device for feeding sheets one by one.

2. Description of the Related Art

In image-forming apparatuses, such as copy machines and printers, sheets of paper which can be fed continuously are normally limited to sheets of high-quality paper or normal paper produced by designated manufacturers. These kinds of paper have non-smooth surfaces and are highly permeable to air (easy for air to pass through), and air can easily flow between the sheets. Therefore, when the sheets stored in a stacked state are taken out one by one, double feeding, in which two or more sheets adhere to each other and are fed together, does not easily occur.

On the other hand, in accordance with the diversification of recording paper and growing need for color printing, there is an increasing demand to form images on sheets with smooth surfaces, such as cardboard sheets, overhead projector (OHP) sheets, sheets of tracing paper, and sheets of art paper and coated paper having surfaces coated to increase whiteness or glossiness. However, since the OHP sheets, the sheets of tracing paper, and the sheets of art paper and coated paper have smooth surfaces and are not very permeable to air (difficult for air to pass through), they easily stick to each other, particularly when they are stacked in high-humidity conditions. Therefore, there is a problem that double feeding or misfeeding easily occurs when a friction method, which is commonly used in known copy machines and printers, is used for separating the sheets.

Accordingly, methods for preventing sheets with low air-permeability from sticking to each other have been suggested. For example, U.S. Pat. No. 6,015,144 discloses a structure in which air is blown against a stack of sheets from the side to reduce the adhesion force between the sheets having smooth surfaces. In addition, Japanese Patent Laid-Open No. 6-32473 discloses a structure in which air is heated by a dehumidifier heater disposed in a lower section and is blown along the top surface of the uppermost sheet on a paper tray or along the side of a stack of sheets by an air-exhaust ventilator to reduce the adhesion force between the sheets having smooth surfaces. In addition, Japanese Patent Laid-Open No. 2001-48366 discloses a structure including an air heater for maintaining the humidity of air to be blown against sheets within a predetermined level by heating the air depending on the temperature or humidity of external air and a pre-heating temperature detector for detecting the temperature of the air before being heated, so that the conveyability of the sheets is improved and the quality of the output sheets is maintained.

In known sheet-feeding devices, when a storage unit is opened for refilling it with paper or for other reasons, electricity to the heater is normally shut off in order to save power. Accordingly, the temperature of the heater decreases when the storage unit is opened, and a long time is required for the temperature of the heater to reach a set temperature after the storage unit is closed. Accordingly, the downtime of the image-forming apparatus required when the storage unit is refilled with paper is long. The downtime of the image-forming apparatus may be reduced by not shutting off the electricity to the heater when the storage unit is opened. In such a case, however, since the temperature decreases when the storage unit is opened, there is a risk that misdetection of a low-temperature error, that is, an abnormality in which the temperature of the heater does not reach a predetermined temperature, will occur.

SUMMARY OF THE INVENTION

An object of the present invention is to provide a sheet-feeding device which is free from the above-described disadvantages.

Another object of the present invention is to provide a sheet-feeding device in which misdetection of a low-temperature error of a heater is prevented.

Another object of the present invention is to provide a sheet-feeding device which effectively performs temperature control and abnormal temperature detection in a heater.

According to the present invention, a controller continues to control the temperature of a heater but stops determining whether or not the heater temperature is increased to a first predetermined temperature within a predetermined time when a detector detects that a sheet storage unit is in an open state. Therefore, the time from when the sheet storage unit is refilled with sheets until when the sheets can be fed is reduced. In addition, misdetection of the abnormality in which the heater temperature does not reach the first predetermined temperature within the predetermined time is prevented.

Further objects, features and advantages of the present invention will become apparent from the following description of the preferred embodiments with reference to the attached drawings and the appended claims.

DESCRIPTION OF THE PREFERRED EMBODIMENT

Overall Structure

Figure 1:
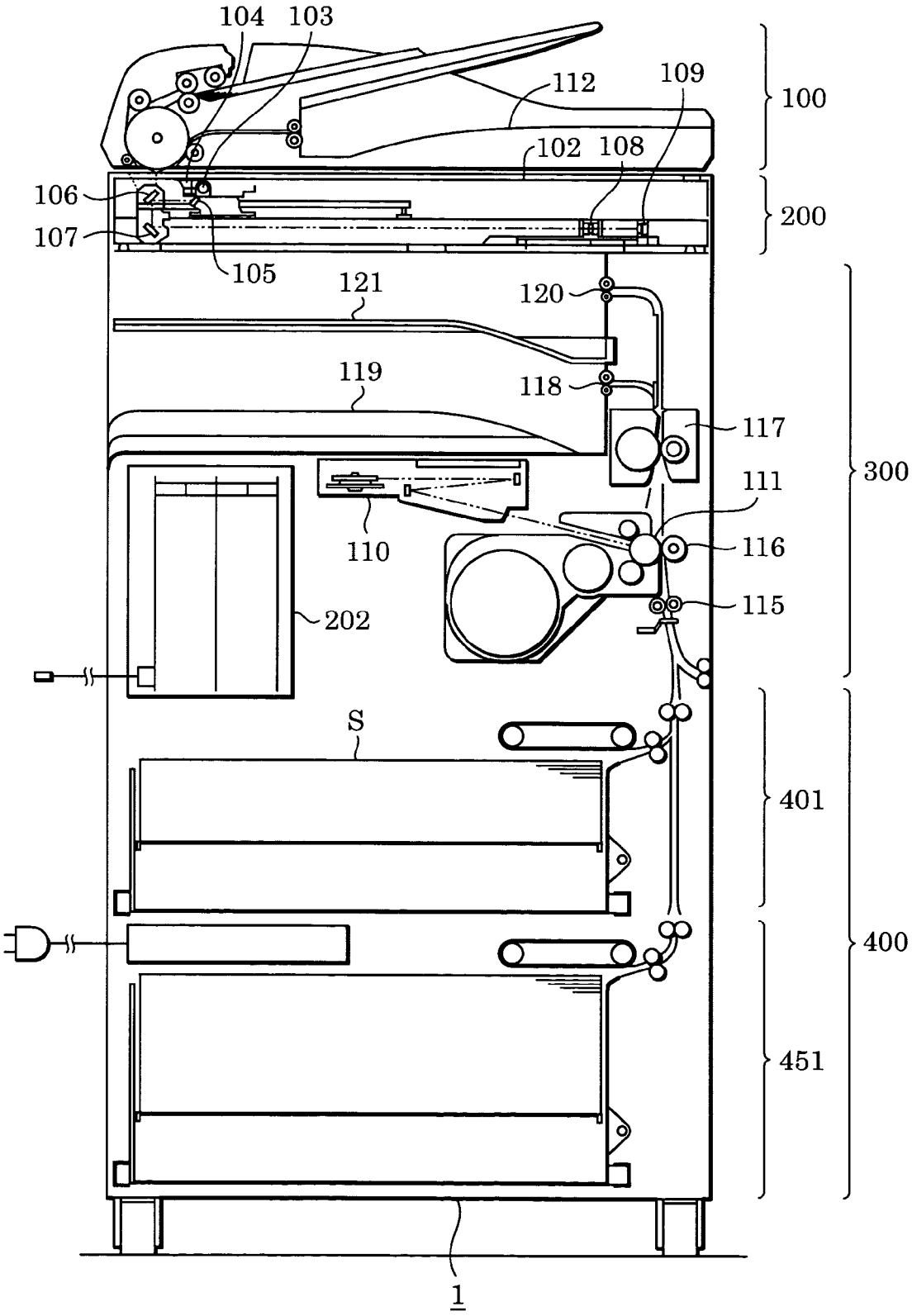
FIG. 1 is a schematic diagram showing the cross-sectional structure of an image-forming apparatus.

FIG. 1 is a schematic diagram showing the cross-sectional structure of an image-forming apparatus 1. As shown in FIG. 1, the image-forming apparatus 1 includes an image reader 200 for reading an image of an original document, a printer 300, and a paper feeder 400. The paper feeder 400 includes paper decks 401 and 451 having a common paper-feeding mechanism. The capacity of the paper deck 401 is 1,000 sheets, and that of the paper deck 451 is 1,500 sheets.

An original-document feeder 100 is mounted on the image reader 200. The original-document feeder 100 includes a document tray on which an original document is placed such that it faces upward, and feeds the original document sheet by sheet from the top page thereof in the leftward direction. The original document is fed along a curved path, conveyed along a platen glass 102 from left to right via a flow-scanning position, and is then output onto an external output tray 112. When the original document passes by the flow-scanning position on the platen glass 102 from left to right, an image on the original document is read by a scanner unit 104 which is stopped at a position corresponding to the flow-scanning position. This reading method is commonly called a flow-scanning method. In this method, when the original document passes by the flow-scanning position, the surface of the original document is irradiated with light emitted from a lamp 103 included in the scanner unit 104, and light reflected by the original document is guided to a lens 108 via mirrors 105, 106, and 107. The light passes through the lens 108, and forms an image on an imaging surface of an image sensor 109.

When the original document is conveyed such that it passes by the flow-scanning position from left to right, it is scanned in a main-scanning direction which is perpendicular to the conveying direction of the original document and in a sub-scanning direction which is the same as the conveying direction. More specifically, when the original document passes by the flow-scanning position, the image sensor 109 reads the image on the original document along a line in the main-scanning direction while the original document is conveyed in the sub-scanning direction, and the overall image is thereby read out. Then, the optically read out image is converted into image data by the image sensor 109. Then, the image data output from the image sensor 109 is subjected to predetermined processes in an image-signal controller 202, and is then input to an exposure controller 110 of the printer 300 as a video signal.

The image on the original document may also be read by conveying the original document to a predetermined position on the platen glass 102 by the original-document feeder 100 and moving the scanner unit 104 from left to right while the original document is stationary. This reading method is commonly called a stationary-document reading method.

In the case in which an original document is read without using the original-document feeder 100, a user lifts up the original-document feeder 100 and places the original document on the platen glass 102. Then, the scanner unit 104 moves from left to right to read the image on the original document. Thus, the stationary-document reading method is used when the original document is read without using the original-document feeder 100.

The exposure controller 110 of the printer 300 modulates a laser beam on the basis of the input video signal, and a polygon mirror deflects the modulated laser beam such that the photosensitive drum 111 is scanned by the laser beam. Accordingly, an electrostatic latent image corresponding to the laser beam is formed on the photosensitive drum 111. When the stationary-document reading method is used, the exposure controller 110 outputs the laser beam such that a correct image (image which is not a mirror image) is formed, as will be described below.

The electrostatic latent image on the photosensitive drum 111 is visualized with developer supplied from a development device (not shown) as a developer image. A sheet S is fed from one of the paper decks 401 and 451, and is conveyed to a position between the photosensitive drum 111 and a transfer unit 116 at a time synchronized with the start of irradiation of the laser beam by the registration rollers 115. The developer image formed on the photosensitive drum 111 is transferred onto the supplied sheet by the transfer unit 116.

The sheet onto which the developer image is transferred is conveyed to a fixing device 117, and the fixing device 117 fixes the developer image on the sheet by applying heat and pressure. After the sheet passes through the fixing device 117, a flapper (not shown) is switched such that the sheet is output to a first output tray 119 from a first output roller 118 or to a second output tray 121 from a second output roller 120.

Figure 2:
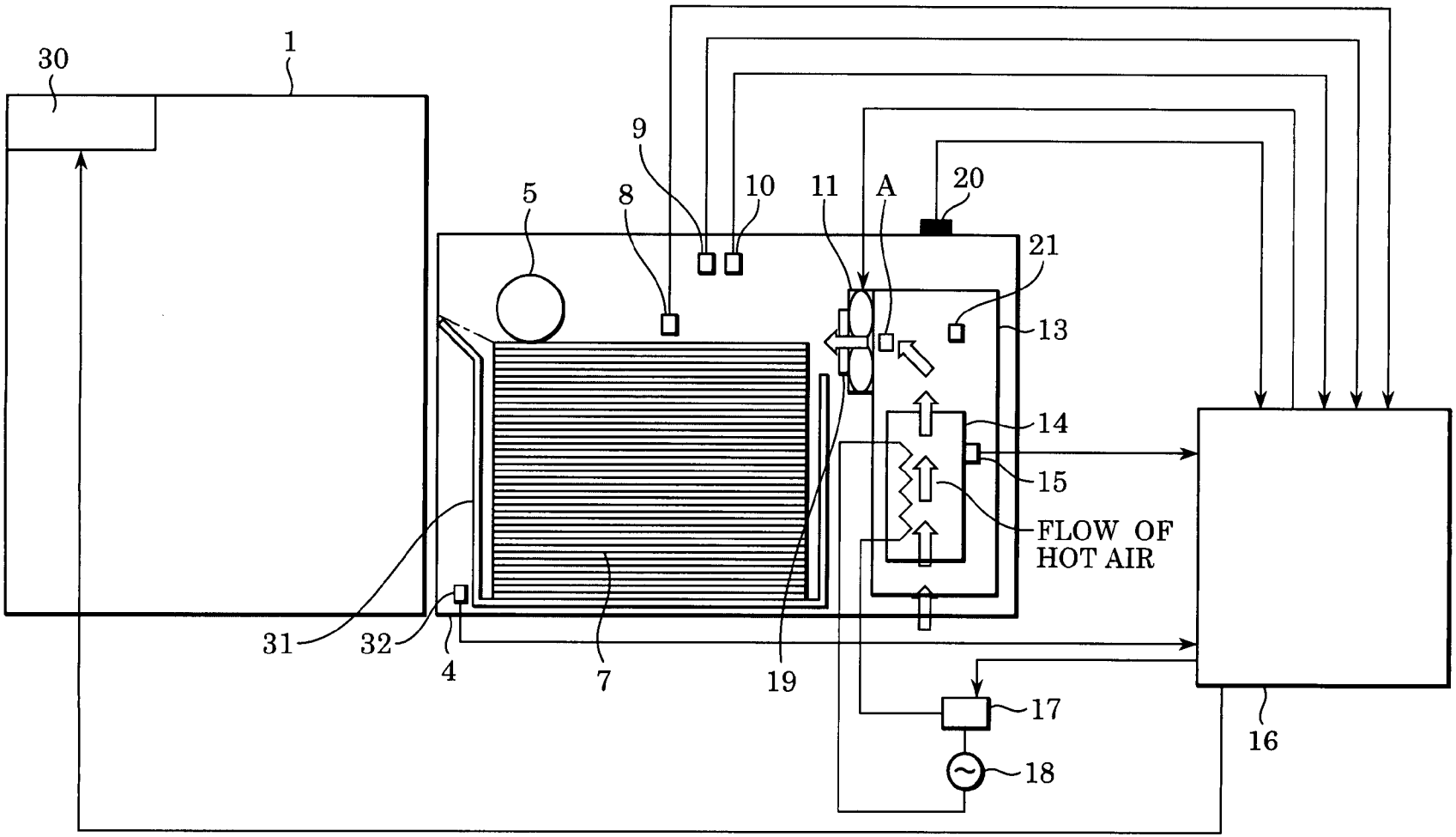
FIG. 2 is a diagram showing the structure of a paper deck according to an embodiment of present invention.

Next, a paper deck 4 having an air-separation mechanism and a heater will be described below. As shown in FIG. 2, the paper deck 4 is attached to the image-forming apparatus 1. The inner structure of the paper deck 4 described below may also be provided in the paper decks 401 and 451.

In FIG. 2, the image-forming apparatus 1 forms an image on sheets 7 supplied from the paper deck 4. A pick-up roller 5 rotates and feeds the uppermost sheet to the image-forming apparatus 1.

A sheet detection sensor 8 detects the thickness, density, and size of the sheets 7, and transmits the obtained information to a controller 16. In addition to using the sheet detection sensor 8, the information regarding the sheets 7 may also be input by a user through an operating unit or the like provided on the image-forming apparatus 1.

A temperature detection sensor 9 and a humidity detection sensor 10 detect the temperature and humidity, respectively, in the paper deck 4 and transmit the obtained information to the controller 16.

A fan 11 blows hot air toward a region around the uppermost sheet to separate the sheets 7 from each other, and prevents double feeding which easily occurs when the sheets 7 are coated paper or the like. A swing shutter 19 moves up and down to partly block or allow the passage of the hot air blown from the fan 11 to separate the sheets 7 from each other. The swing shutter 19 is driven by a swing motor (not shown).

An air heater 14 is disposed in a duct 13, and air is drawn into the duct 13 from below, heated by the air heater 14, and blown out by the fan 11 in the present embodiment.

The air heater 14 receives an AC voltage 18 from the controller 16 via a solid-state relay (SSR) 17 for performing on/off control of the AC voltage 18, and the air supplied from below the duct 13 is heated by heat radiated from a resistor included in the air heater 14.

A heater-temperature detection sensor 15 is in contact with the air heater 14 and transmits information regarding the temperature of the air heater 14 to the controller 16. The controller 16 performs the on/off control of the AC voltage 18 using the SSR 17 on the basis of the information transmitted from the heater-temperature detection sensor 15, and thereby adjusts the temperature of the air heater 14 to a predetermined temperature.

The operation from when the air heater 14 starts heating the air for separating the sheets 7 from each other until when the pick-up roller 5 starts feeding the sheets 7 will be described below.

Figure 3A:
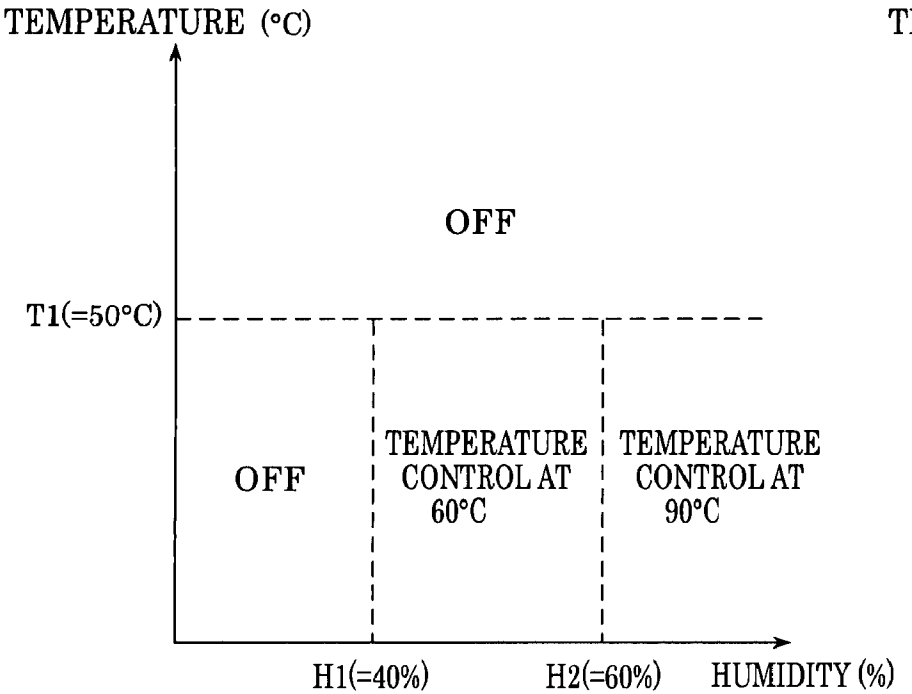
FIGS. 3A and 3B are charts showing conditions under which electricity is supplied to an air heater.
Figure 3B:
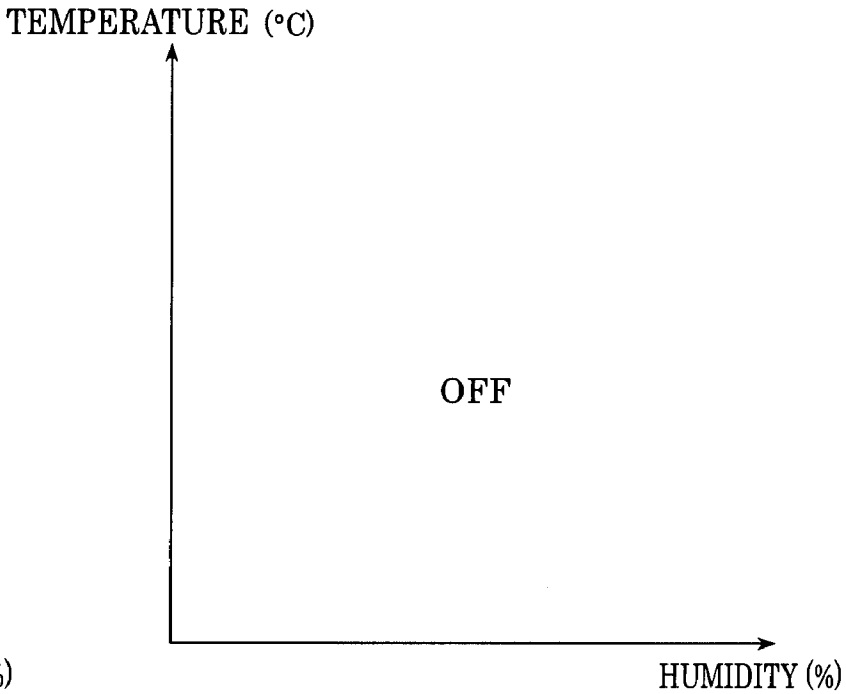

First, a desired heater temperature is determined on the basis of the temperature information and the humidity information transmitted to the controller 16 from the temperature detection sensor 9 and the humidity detection sensor 10, respectively, and the information regarding the thickness, density, and size of the sheets 7 transmitted to the controller 16 from the sheet detection sensor 8. The controller 16 determines the desired heater temperature on the basis of a program for executing a determination flow corresponding to charts shown in FIGS. 3A and 3B.

For example, it is assumed that the output from the sheet detection sensor 8 indicates that the sheets 7 are coated paper, the output from the temperature detection sensor 9 is 25° C., and the output from the humidity detection sensor 10 is 70%. In this case, the controller 16 sets the desired heater temperature to 90° C.

In order to control the temperature of the air heater 14, the controller 16 turns on the SSR 17 and supplys electricity to the air heater 14 to increase the temperature thereof when the output from the heater-temperature detection sensor 15 is less than 90° C. In addition, the controller 16 turns off the SSR 17 to shut off the electricity to the air heater 14 if the output is 90° C. or more.

In addition, if the output from the sheet detection sensor 8 indicates that the sheets 7 are uncoated paper, the electricity to the air heater 14 is shut off. In other words, the controller 16 maintains the state in which the SSR 17 is turned off.

Next, error detection of the air heater 14 performed by the controller 16 will be described below. A high-temperature error is detected when the heater-temperature detection sensor 15 detects that the heater temperature is increased to a predetermined temperature. In such a case, the controller 16 displays a message describing the situation on an operation screen 30 of the image-forming apparatus 1, and restricts the use of the paper deck 4 or the overall image-forming system (the system including the image-forming apparatus 1 and the paper deck 4). In order to prevent the abnormal temperature increase in the air heater 14, a thermo switch 21 is provided on the air heater 14. Detection of high temperature is performed using a predetermined timer included in the controller 16.

A low-temperature error is detected when the heater temperature does not reach a set temperature within a predetermined time from when the supply of electricity to the air heater 14 is started. Also in this case, the controller 16 displays a message describing the situation on the operation screen 30 of the image-forming apparatus 1, and restricts the use of the paper deck 4 or the overall image-forming system. For example, when the output from the sheet detection sensor 8 indicates that the sheets are coated paper, the output from the temperature detection sensor 9 is 25° C., and the output from the humidity detection sensor 10 is 70%, the desired heater temperature is set to 90° C. from FIG. 3A. In this case, if the output from the heater-temperature detection sensor 15 does not reach 90° C. within the predetermined time, it is determined that some kind of failure has occurred in the air heater 14 itself or in the control system of the air heater 14. Accordingly, a display indicating the low-temperature error of the air heater 14 is shown on the operation screen 30 of the image-forming apparatus 1.

When a user presses an open switch 20, the controller 16 disengages a latch (not shown) of a storage unit 31 in the paper deck 4 so that the user can pull out the storage unit 31. When the state in which the storage unit 31 is pulled out is detected by a storage-unit sensor 32, the controller 16 continuously supplies the electricity to the air heater 14 so as to prevent the temperature in the air heater 14 from being reduced.

When the storage unit 31 is opened, heat in the paper deck 4 is dissipated and the temperature is reduced compared to that in the state in which the storage unit 31 is closed. Accordingly, there is a risk that misdetection of the low-temperature error, which is an abnormality in which the temperature of the air heater 14 does not reach the predetermined temperature, will occur. In order to prevent this, the controller 16 does not detect the low-temperature error of the air heater 14 when the storage-unit sensor 32 is detecting that the storage unit 31 is opened. However, the controller 16 continuously detects the high-temperature error of the air heater 14 even when the storage-unit sensor 32 is detecting that the storage unit 31 is opened.

When the storage-unit sensor 32 detects that the storage unit 31 is closed, the controller 16 restarts the detection of the low-temperature error. More specifically, an error-detection timer is started at the time when it is detected that the storage unit 31 is closed, and a message describing that the low-temperature error has occurred is displayed on the operation screen 30 if the temperature of the air heater 14 does not reach the set temperature within the predetermined time.

Figure 4:
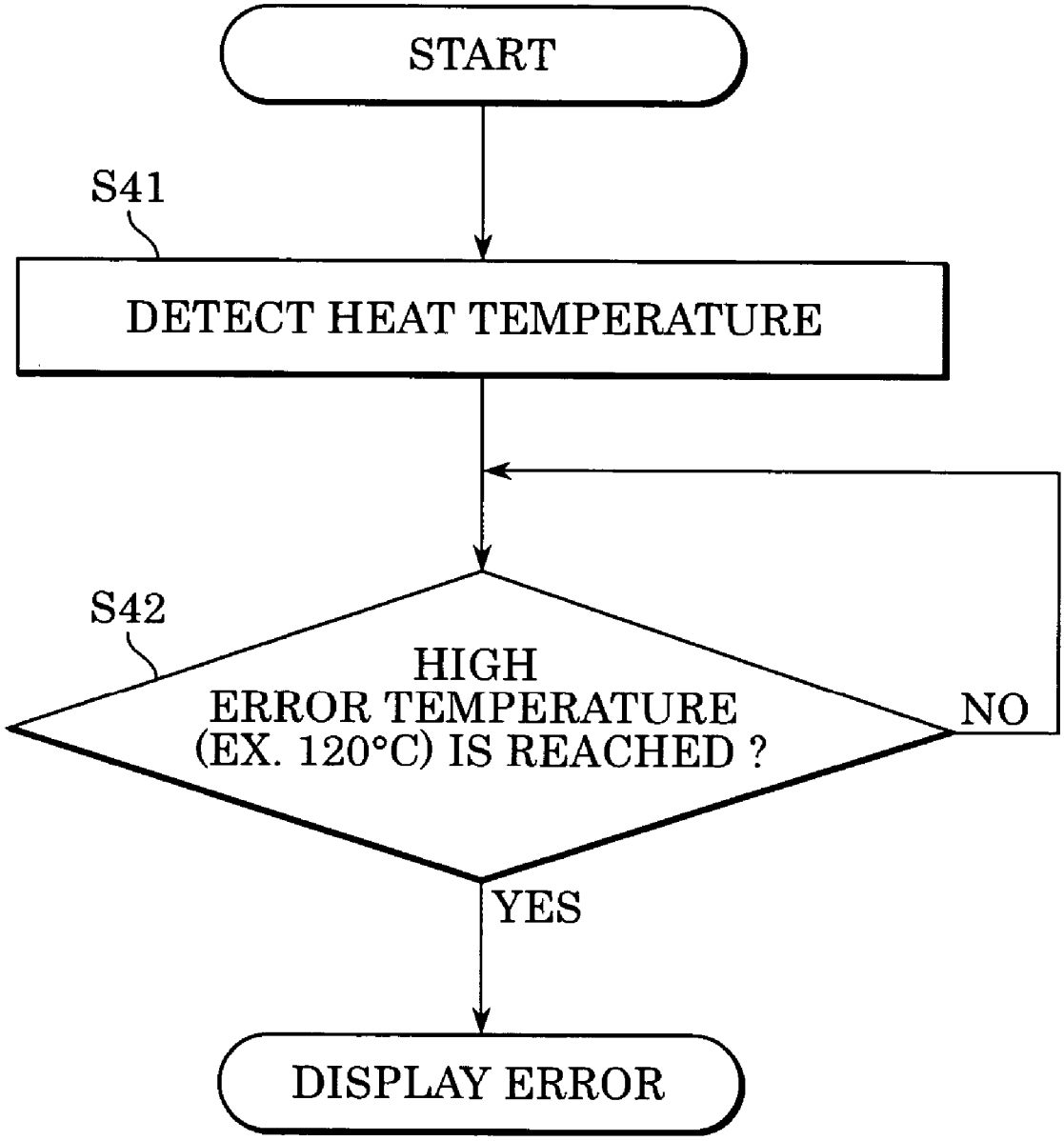
FIG. 4 is a flowchart of a process for detecting a high-temperature error.

A method for detecting the errors in the air heater 14 will be described below with reference to flowcharts of FIGS. 4 and 5. The flowchart shown in FIG. 4 shows a process for detecting the high-temperature error of the air heater 14. The controller 16 constantly performs the detection of the high-temperature error of the air heater 14 on the basis of the output from the heater-temperature detection sensor 15 (Step 41). When the heater-temperature detection sensor 15 detects that the temperature of the air heater 14 is increased to a high error temperature (120° C. in FIG. 4) in Step 42, a message describing that the high-temperature error of the air heater 14 has occurred is displayed on the operation screen 30. Although the heater-temperature detection sensor 15 may detect either of the temperatures inside and outside the air heater 14, the high error temperature is set to different values depending on which temperature is detected.

Figure 5:
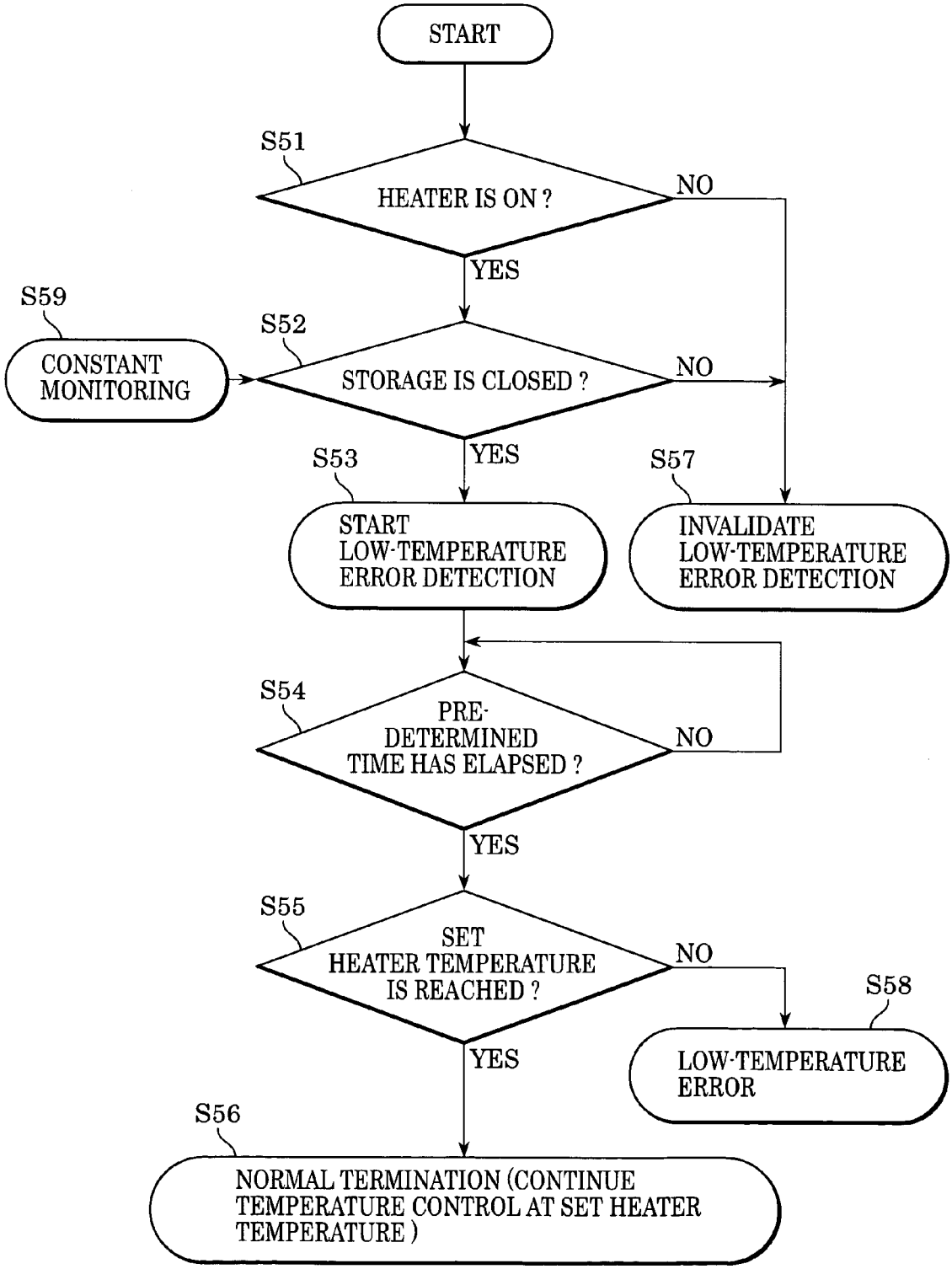
FIG. 5 is a flowchart of a process for detecting a low-temperature error.

The flowchart shown in FIG. 5 shows a process for detecting the low-temperature error of the air heater 14. When the electricity is supplied to the air heater 14 under conditions shown in FIG. 3A, the controller 16 performs the control process shown in FIG. 5. When the electricity is supplied to the air heater 14 (Step 51) and when the storage unit 31 of the paper deck 4 is in the closed state (Step 52), the low-temperature error detection is started (Step 53). The sum of a time normally required for the temperature of the air heater 14 to reach the set temperature and an allowance is set as the predetermined time. When the predetermined time elapses after the start of the low-temperature error detection (Step 54), it is determined whether the temperature of the air heater 14 is increased to the set temperature (Step 55). If the temperature of the air heater 14 is increased to the set temperature, it is determined that the air heater 14 is operating normally (Step 56). However, if the temperature of the air heater 14 is not increased to the set temperature within the predetermined time, it is determined that the low-temperature error has occurred and the message describing that the low-temperature error of the air heater 14 has occurred is displayed on the operation screen 30 (Step 58).

The open/closed state of the storage unit 31 of the paper deck 4 is constantly monitored (Step 59), and when it is detected that the storage unit 31 is opened (Step 52), the low-temperature error detection is invalidated or stopped even when the low-temperature error detection is being performed (Step 57). In addition, when the electricity to the air heater 14 is shut off (Step 51), the low-temperature error detection is not performed (Step 57).

The present invention may also be implemented as a computer program corresponding to the above-described control processes provided from outside the sheet-feeding device.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet-feeding device comprising:

a sheet storage unit which stores a plurality of sheets;

a feeder which feeds the sheets stored in the sheet storage unit;

a heater which heat the sheets stored in the sheet storage unit;

a controller which controls the temperature of the heater and detecting a first abnormality when the temperature of the heater does not reach a first predetermined temperature; and a detector which detects an open/closed state of the sheet storage unit, wherein the controller continues to control the temperature of the heater but stops detecting the first abnormality if the detector detects that the sheet storage unit is in an open state.

2. The sheet-feeding device according to claim 1, wherein the controller detects the abnormality when the temperature of the heater does not reach the first predetermined temperature within a predetermined time after the start of the temperature control of the heater.

3. The sheet-feeding device according to claim 2, wherein the controller starts measuring the predetermined time when the detector detects that the state of the sheet storage unit is changed from the open state to a closed state.

4. The sheet-feeding device according to claim 1, wherein the controller detects a second abnormality when the temperature of the heater exceeds a second predetermined temperature which is higher than the first predetermined temperature, and continues to monitor whether or not the temperature of the heater is higher than the second predetermined temperature even when the detector detects that the sheet storage unit is in the open state.

5. The sheet-feeding device according to claim 1, further comprising a fan which causes air heated by the heater to flow toward the sheets stored in the sheet storage unit.

6. A method for controlling a sheet-feeding device including a sheet storage unit which stores a plurality of sheets, a feeder which feeds the sheets stored in the sheet storage unit, a heater which heat the sheets stored in the sheet storage unit, and a detector which detects an open/closed state of the sheet storage unit, the method comprising:

a first controlling step of adjusting the temperature of the heater at a predetermined temperature;

a determining step of determining that an abnormality has occurred when the temperature of the heater does not reach the predetermined temperature after the first controlling step; and a second controlling step of continuing the first controlling step but invalidating the determination of the abnormality in the determining step when the detector detects that the sheet storage unit is in an open state.

7. The method according to claim 6, wherein the second control step prohibits the execution of the determining step.

* * * * *